United States Patent [19]

Ohashi et al.

[11] Patent Number: 5,056,209

[45] Date of Patent: Oct. 15, 1991

[54] PROCESS FOR MANUFACTURING CLAD METAL TUBING

[75] Inventors: Yoshihisa Ohashi, Takarazuka; Mutsuo Nakanishi, Kobe; Shigeharu Takai; Junichi Kikuchi, both of Nishinomiya; Tadashi Fukuda, Amagasaki; Nobushige Hiraishi, Nishinomiya, all of Japan

[73] Assignee: Sumitomo Metal Industries, Ltd., Osaka, Japan

[21] Appl. No.: 448,010

[22] Filed: Dec. 8, 1989

[30] Foreign Application Priority Data

| | | | |
|---|---|---|---|
| Dec. 9, 1988 | [JP] | Japan | 63-312338 |
| Dec. 28, 1988 | [JP] | Japan | 63-334600 |
| May 19, 1989 | [JP] | Japan | 1-127534 |

[51] Int. Cl.[5] ..... B21D 39/00

[52] U.S. Cl. ..... 29/517; 29/521; 29/890.036; 29/890.053; 29/890.054; 138/143; 419/6; 419/8

[58] Field of Search ..... 72/258; 29/517, 447, 29/521, 157.3 H, 157.3 R, 890.053, 890.054, 890.032, 890.036; 138/141, 140, 143; 419/6, 8

[56] References Cited

U.S. PATENT DOCUMENTS

| | | | |
|---|---|---|---|
| 3,604,102 | 9/1971 | Boccalari et al. | 228/131 |
| 4,016,008 | 4/1977 | Forbes et al. | 138/143 |
| 4,598,856 | 7/1986 | Bilbao-Eguigren et al. | 228/131 |
| 4,721,598 | 1/1988 | Lee | 419/8 |
| 4,844,863 | 7/1989 | Miyasaka et al. | 419/29 X |

FOREIGN PATENT DOCUMENTS

| | | | |
|---|---|---|---|
| 3334110 | 3/1985 | Fed. Rep. of Germany . | |
| 0223611 | 11/1985 | Japan | 72/258 |

OTHER PUBLICATIONS

Patent Abstracts of Japan, vol. 13, No. 577 (M-910), Dec. 20, 1989 (JP-A-01-241322, Sep. 26, 1989).

*Primary Examiner*—Joseph M. Gorski
*Assistant Examiner*—S. Thomas Hughes
*Attorney, Agent, or Firm*—Burns, Doane, Swecker & Mathis

[57] ABSTRACT

A process for manufacturing clad metal tubing from two different types of metals having different deformation resistances is disclosed. The process comprises preparing a combined billet having two blank pipes arranged concentrically with each other, the pipes being made of different metals, and applying hot extrusion to the billet while adjusting the heating temperature of the pipe such that a pipe of the metal having a higher deformation resistance is heated to a higher temperature.

35 Claims, 6 Drawing Sheets

PROCESS FOR MANUFACTURING CLAD METAL TUBING

BACKGROUND OF THE INVENTION

The present invention relates to a process for manufacturing clad metal tubing by hot extrusion, in which one metal (or alloy) is clad to another metal (or alloy) having a deformation resistivity substantially different from that of the first one. Under usual conditions it is rather difficult to apply hot working, such as hot extrusion, to the combination of these different types of metals to produce a sound clad material. However, according to the present invention clad metal tubing can be obtained which is substantially free from surface defects and other defects.

Clad materials have been used widely in various applications. A clad material is a combination of two different types of metals (the term "metal" herein means both a pure metal and alloys thereof) in which desirable characteristics of each of the metals can be utilized.

Therefore, a variety of metals and combinations thereof are known in industry. The clad material produced in the largest amount is clad steel plate in which one of the metals (called the "parent metal") is carbon steel, low alloy steel, or the like and the other metal is stainless steel, titanium, or other corrosion resistant material.

Cladding has also been practiced in manufacturing many types of tubing. The most popular process for manufacturing seamless clad pipes is hot extrusion, e.g. the Ugine-Sejournet extrusion process, which is shown in FIG. 1.

In FIG. 1, blank pipes 1, 2 of different types of metals are combined to make a billet 3. The billet 3 is heated to a high temperature, and then subjected to hot extrusion. Manufacturing costs and properties of the product tubing are important considerations in determining the materials to be used for the blank pipes. For example, for use in line piping in which not only high strength but also improved resistance to corrosion are required, it is advantageous to use clad tubing comprising carbon steel or low alloy steel, which is less expensive and of high strength as the parent metal, and a nickel-base alloy with improved resistance to corrosion as the cladding layer. However, when clad tubing of this type is manufactured by conventional hot extrusion, a combined billet 3 is prepared by assembling a blank pipe 1 of carbon steel (or low alloy steel) and another blank pipe 2 of a nickel-based alloy. Usually, such hollow, thick-walled pipings are manufactured by a series of steps of melting, casting, forging, and machining (e.g. boring). The smaller one is inserted into the larger one to assemble a combined billet. After being heated to a predetermined temperature in a heating furnace and/or induction heating furnace, the combined billet is subjected to hot extrusion.

However, the hot extrusion of the prior art results in the following disadvantages.

1) Problems regarding surface characteristics of the product tubing:

One of the two metals, especially the one constituting the cladding layer, e.g., a nickel-base alloy in the case where carbon steel is clad with nickel-base alloy, is usually hard to work and the resulting cladding material suffers from various defects and cracking on the surface thereof.

2) Problems regarding bonding strength:

Bonding between the parent metal and the cladding metal is not perfect, and the strength therebetween is rather low. When the two metal layers are unbonded, hydrogen ions go into the space between the two layers to widen the space due to generation and expansion of hydrogen gas, resulting in swelling of the piping and a decrease in mechanical strength.

3) Problems regarding manufacturing costs:

Since many manufacturing steps are required until a combined billet is prepared, and the yield rate of product with respect to raw material is very small, manufacturing costs are very high. Carbon steel and low alloy steel are less expensive, and the efficiency of material thereof does not have any substantial effect on the manufacturing cost of the final product. However, the yield rate of the blank pipe of a nickel-base alloy which is very expensive has a great effect on the manufacturing cost of the final product. Furthermore, it is time-consuming to perform forging and machining of such a nickel-base alloy in order to manufacture a blank pipe, since it is very hard to apply forging and machining to the nickel-based alloy.

One of the solutions of problems 2 and 3 is to use metal powder as a starting material for manufacturing the blank pipe. For example, a wrought material is used to prepare a parent pipe of carbon steel or low alloy steel, and a powder material is used to prepare a cladding layer. Such powder metallurgical processes have been proposed in the following literature:

(1) U.S. Pat. No. 3,753,704.

(2) U.S. Pat. No. 4,016,008 (Japanese Patent Publication 60-37162)

(3) Japanese Unexamined Patent Application Disclosure 61-190006

(4) Japanese Unexamined Patent Application Disclosure 61-190007

According to the processes disclosed therein, as shown in FIG. 2, a combined billet is prepared, heated, and subjected to hot extrusion.

The combined billet shown in FIG. 2 is comprised of a hollow cylinder 1 (parent pipe) made of carbon steel or the like, a thin-walled metal pipe 5 (sometimes referred to as a "capsule"), and a powder-packed layer 4 provided between the hollow cylinder 1 and the thin-walled metal pipe 5. The upper and lower ends are sealed by end plates 6-1 and 6-2, respectively.

The thus-prepared billet is then heated to a predetermined temperature after the powder layer 4 is further packed by a cold isostatic pressing process or the like, if necessary. The heated billet is hot extruded to form clad tubing. During hot extrusion, the powder layer 4 is consolidated due to heating, compaction, and shear deformation to form a cladding alloy layer which is bonded to the inner surface of a parent layer comprising the deformed hollow cylinder 1. After deformation through hot extrusion, the end plates 6-1 and 6-2 and the thin-walled metallic pipe 5 are removed by pickling.

Usually, the hollow cylinder 1 is made of a relatively inexpensive and easily deformable material such as a carbon steel or low alloy steel. The powder-packed layer 4 is made of a powdery alloy which exhibits excellent resistance to corrosion. A typical such alloy is a nickel-base alloy. When powder is used, the yield of the product is almost 100% with respect to the starting material. This is very advantageous from an economic viewpoint.

FIG. 2 shows the case in which a cladding layer is provided in the inner surface layer of the pipe. The cladding layer may be placed in the outer surface layer of the pipe depending on the purpose for which the pipe is used. In that case, a capsule 5 is provided around the outer surface of the parent pipe 1, and powder is packed in an annular space between the capsule 5 and the parent pipe 1 to form a powder-packed layer 4.

It is to be noted that in this specification, the term "blank pipe" refers not only to a powder-packed layer in the form of a hollow cylinder which is formed by packing powder into a capsule, i.e., a thin-walled metal pipe but also to a wrought or machined hollow cylindrical metal. These two blank pipes may constitute a combined billet.

As is described in the above, when powdery metal is used to prepare a blank pipe, the bonding strength between the two blank pipes at the interface thereof is further improved in comparison with the case in which the two blank pipes are made of wrought metals. This is because upon hot extrusion particles which constitute metal powder bite into the surface of the other parent pipe to break down a thin oxide film. Thus, a fresh surface is formed to ensure reliable and improved bonding in comparison with the prior art cladding.

A hot extrusion process utilizing a combined billet in which a powder-packed layer is used as one of the blank pipes has been practiced only as a process for manufacturing carbon steel and stainless steel clad tubing. However, problem 1 mentioned earlier has not yet been solved.

Namely, when a hot extrusion process is applied to a combined billet which comprises a carbon steel parent pipe and a cladding outer shell of a nickel-base alloy, such as Alloy 825 or Alloy 625, a large, wavy deformation in wall thickness is produced, sometimes resulting in cracks resembling the shape of bamboo joints.

FIG. 15 schematically illustrates such cracks which occurs in a cladding layer having a tendency to be difficult to work. The parent base layer 17 is made of carbon steel which is easy to work and the cladding layer 18 which constitutes the inner layer of the tubing is made of a nickel-base alloy which is hard to work.

As shown in FIG. 15, although the thickness of the parent layer is somewhat irregular, there is a remarkable degree of nonuniformity in thickness of the cladding layer, which is hard to work. It can be seen that in places the cladding layer has been completely ruptured. These ruptured portions 19 are found at regular intervals in the longitudinal direction, similar to the joints of a piece of bamboo. Such defects, therefore, will be referred to as "joint-like cracks".

This type of defect cannot be remedied by subsequent handling or working, so the clad tubing would have to be scrapped if it occurs.

One of the causes of these joint-like cracks is that the resistance to deformation of a nickel-base alloy is high and the alloy is hard to work. Therefore, in order to eliminate joint-like cracks it seems to be helpful to heat the starting materials to a high temperature before working so as to decrease their resistance to deformation.

However, when the heating temperature of a billet is higher than the solidus line of the nickel alloy, intermetallic compounds are concentrated along crystal grain boundaries and a portion of the compounds may turn into a liquid phase. A degradation in the ease of pipe formation and the properties of the product is inevitable. Thus, increasing the heating temperature of a hard-to-work material is not a good way to solve the above-described problems of the prior art. In addition, it is impossible to completely remove the joint-like defects only by heating the starting materials to a high temperature. Thus, such an approach would result in nothing but energy loss.

As already mentioned, flaws and cracks in the surface of tubing require many steps to remedy. In particular, it is quite difficult and almost impossible to remove a flaw or crack from the inner surface of tubing, and if the flaw or crack can not be removed, the resulting tubing is of no value.

SUMMARY OF THE INVENTION

One of the objects of the present invention is to provide a process for manufacturing clad metal tubing free from any substantial fluctuation in wall thickness without occurrence of joint-like cracks in the alloy cladding layer by hot extrusion of a combined billet of two different types of metals, the combined billet being made of a combination of two blank pipes of wrought metal or one or both of the blank pipes being made of a powder-packed layer.

Another object of the present invention is to provide a process for manufacturing clad metal tubing free from the above-mentioned defects by hot extrusion of a combined billet in which a powder-packed layer of a hard-to-work alloy such as a nickel-base alloy is used as an inner or outer shell.

After a series of experiments and production operations, the inventors found that fluctuations in the wall thickness of clad metal tubing and joint-like defects are caused mainly by a difference in the deformation resistance of two metals during deformation, but not by the level of the resistance to deformation itself.

In the prior art process, a combined billet denoted by reference numeral 3 in FIG. 1 is prepared to be heated throughout to a given uniform temperature, just like when a mono-metal billet is heated.

As shown in FIG. 8 which will be described in detail hereinafter, at the same working temperature, the deformation resistance varies greatly among different types of metals and alloys. For example, at 1000° C., it is noted that the deformation resistance of Alloy 625 is 4 times larger than that of carbon steel. Thus, the formation of joint-like defects is inevitable when a combined billet of two such different types of metals is heated at the same temperature and then hot extrusion is applied thereto.

Therefore, the inventors noted that the working temperature of the metals to be worked should be varied depending on their deformation resistance.

It was confirmed after a series of experiments that when hot extrusion is performed on a combined billet comprising a first metal having a large deformation resistance and a second metal having a smaller deformation resistance, if the first metal is heated to a temperature higher than the second, fluctuations in thickness are reduced to a low level one for each metal layer, and the formation of joint-like defects and other surface defects is decreased. In addition, when the billet is heated locally to different temperatures, joint-like defects are completely prevented if the heating temperatures are determined so that the ratio of the deformation resistance for the two types of metals which constitute the combined billet is adjusted to 2.5 or smaller.

The present invention resides in a process for manufacturing a clad metal tubing from two different types of metals having different deformation resistances. The process comprises preparing a combined billet having two hollow pipes arranged concentrically with each other, the pipes being made of different metals, and applying hot extrusion to the billet while adjusting the heating temperature of the pipe such that the metal having a higher deformation resistance is heated to a higher temperature.

The term "metal" in this specification means not only a pure metal or alloy but also a material mainly comprising compounds such as intermetallic compounds, metal carbides, and metal nitrides.

DETAILED DESCRIPTION OF THE PREFERRED EMBODIMENTS

Combined billets which can be used in the method of the present invention include the following three types of billets:

(1) A billet in which both of the two blank pipes are manufactured from wrought metal members by machining (hereinafter called a Type I billet);

(2) A billet in which one of the blank pipes is made of a wrought metal and the other one is made of a packed metal powder layer (hereinafter called a Type II billet);

(3) A billet in which both of the two blank pipes are made of packed metal powder layers (hereinafter called a Type III billet).

Figure 1:
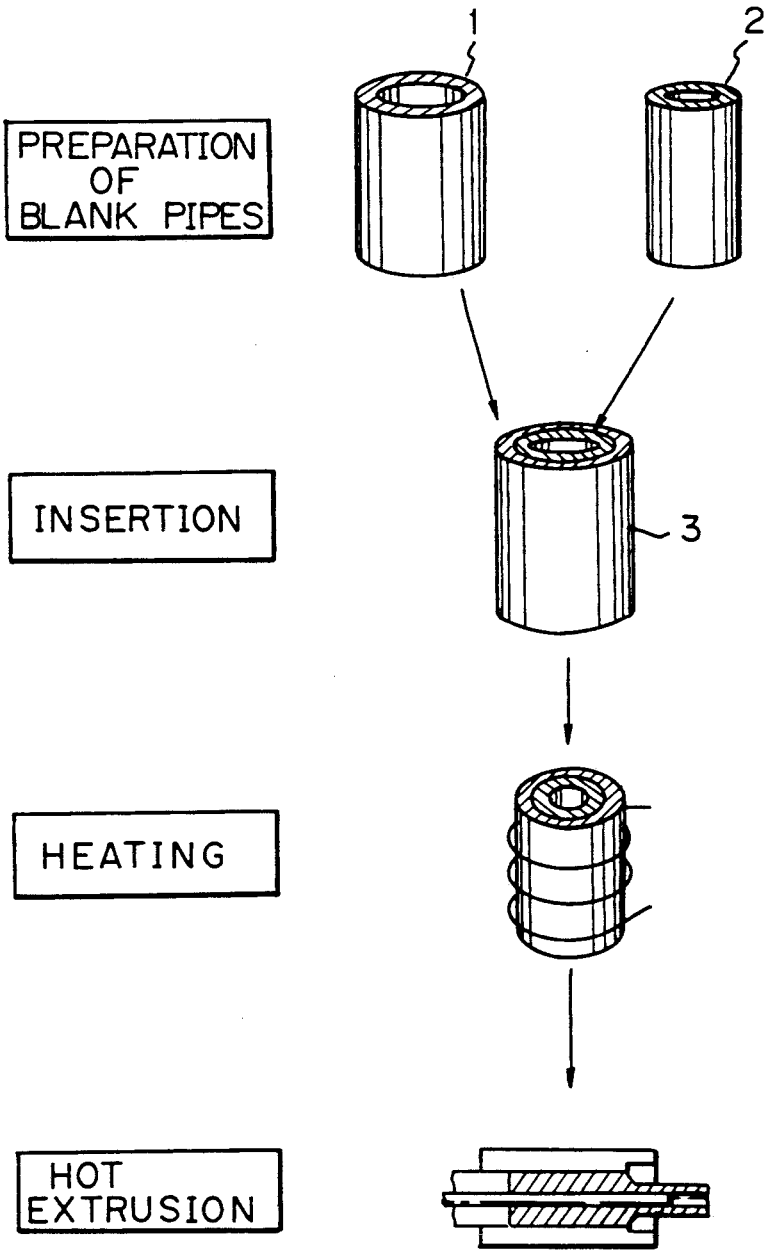
FIG. 1 schematically illustrates a flow chart of the production of clad metal tubing through hot extrusion.

In FIG. 1, billet 3 is a Type I billet. Blank pipes 1 and 2 are prepared by applying forging and machining to wrought metal members to form hollow cylinders and then assembling the hollow cylinders concentrically.

Figure 2:
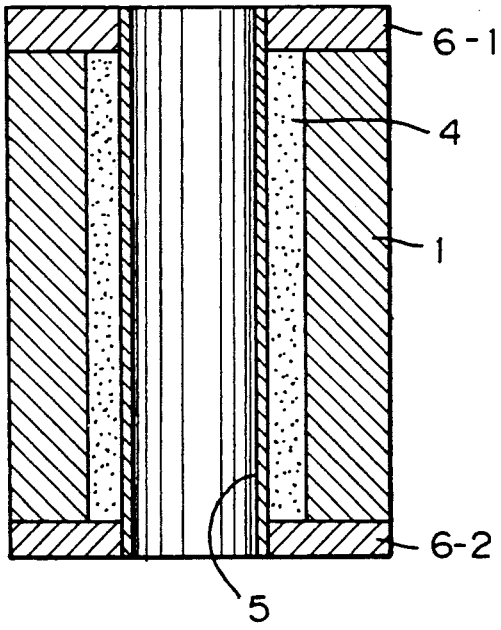
FIG. 2 and FIG. 3 are sectional views of a combined billet in which either one or both of the parent pipes is made of a packed powder layer.

FIG. 2 illustrates a Type II billet. One of the blank pipes (in this case the outer shell 1) is prepared from wrought metal members and the other blank pipe (the inner shell 4) is made of a packed metal powder layer. Usually the wrought metal is carbon steel or low alloy steel, and the packed metal powder is made of an expensive and hard-to-work material, such as a nickel-base alloy. Depending on the use of the clad tubing, the packed metal powder layer may serve as an outer shell.

Figure 3:
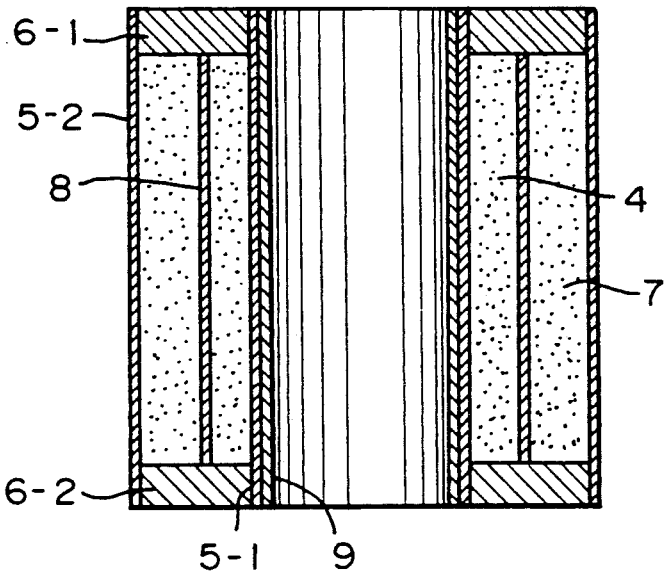

FIG. 3 shows a Type III billet. The billet comprises outer and inner blank pipes made of packed metal powder layers 4, 7 which are partitioned by a wall 8. These packed metal powder layers are prepared by disposing a thin-walled metal tube which constitutes the partition wall 8 between thin-walled capsules 5-1 and 5-2, and packing the thus-formed two annular spaces with two different types of metal powder. As will be detailed hereinafter, a heat-insulating covering tube 9 is provided on the inner side of the inner capsule in the combined billet shown in FIG. 3.

Among these combined billets, the Type-II billet is the most valuable from a practical viewpoint. In case of seamless pipes for use in line pipes, the outer shell is made of carbon steel or a low alloy steel exhibiting a sufficient level of mechanical strength, and the inner shell which has to be highly corrosion resistant is preferably made of a corrosion-resistant nickel-base alloy. Therefore, it is reasonable that the parent blank pipe is prepared from a wrought metal by applying forging as well as machining, and that the cladding layer should be prepared from a packed metal powder layer.

In the case of boiler tubing for use in recovering exhaust heat, it is desirable that the outer shell be made of a cladding layer of a nickel-base alloy which is highly resistant to corrosion. The arrangement of a combined billet in this case is different from that shown in FIG. 2, and the packed metal powder layer is placed on the outer surface of the parent blank pipe made of wrought metal.

Now, the present invention will be further described with reference to the case in which the combined billet comprises, as shown in FIG. 2, an inner layer of a nickel alloy powder.

As has already been mentioned, one of the features of the present invention is that hot extrusion is applied to a combined billet comprising two different types of metals while each of the metallic components of the billet is heated to a different temperature. More specifically, a blank pipe made of a metal having a higher deformation resistance is heated to a temperature higher than the other blank pipe in order to decrease the difference in deformation resistance during deformation. When two different types of metals are used and they are much different from each other in deformation resistance, it is desirable to determine the heating temperature for one of the metals such that the ratio of deformation resistances of the two metals is not more than 2.5, preferably not more than 2.3.

Figure 4:
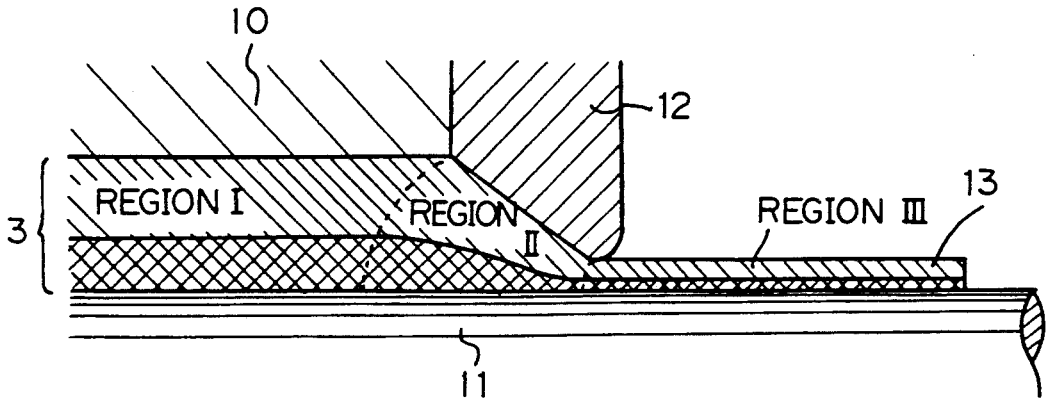
FIG. 4 is a sectional view of a billet schematically showing deformation of the billet during extrusion.

FIG. 4 is a sectional view of a billet, schematically illustrating the deformation of the billet at the die of a hot extrusion apparatus during hot extrusion of a combined billet. A billet 3 contained within a container 10 is deformed between a mandrel 11 and a die 12 to give a tubing 13 of a predetermined wall thickness. The shape of a billet undergoing deformation under usual conditions can be considered to consist of three regions I–III. Region I is a region where the combined billet set within the extrusion apparatus moves to the entrance of the die without being subjected to deformation. Region II is a plastic deformation region where the billet moves toward the outlet of the die while it is being subjected to plastic deformation mainly caused by shearing. Region III is a region where the deformed billet is shaped to a product such as seamless clad tubing and leaves the die.

It is in Region II where deformation resistance is important. In the manufacture of a clad pipe, if the difference in the deformation resistance of the two different types of metals is large in this area, the thickness of the metal layer having the larger deformation resistance will be changed periodically, frequently resulting in the formation of joint-like cracks on the surface thereof. The region of deformation during extrusion mentioned in this specification corresponds to Region II. Even if one or both of the two shells is made of a packed metal powder layer, the packed layer is thoroughly compacted by means of upsetting before the leading edge of the combined billet comes past the die. Therefore, there is no difference in the behavior each of the powder-packed layer and the wrought alloy layer during deformation.

Deformation resistance will now be explained in further detail. This explanation is valid whether the combined billet is made of wrought metals, or one or both of the blank pipes are made of a packed metal powder layer.

Factors which have an influence on deformation resistance include plastic strain, the strain rate, and the processing temperature.

Figure 5:
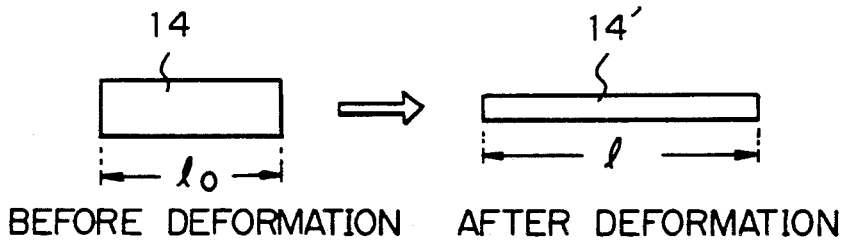
FIG. 5 is a view explaining the amount of plastic deformation.

FIG. 5 is an explanatory illustration of what is meant by plastic stain.

Generally speaking, plastic strain of a test piece 14 after deformation can be expressed by the following formula:

$$\epsilon = \ln \frac{l}{l_0}$$

wherein $l_0$ is the length of the test piece 14 before deformation and l is the length of the test piece 14' after deformation.

In the case where tubing is manufactured from a billet through extrusion, the plastic strain can be expressed by the following formula:

$$\epsilon = \ln \frac{l}{l_0} = \ln \gamma$$

wherein $l_0$ is the length of the billet before extrusion, l is the length of the product tubing, and $\gamma$ is the extrusion ratio.

In the manufacture of metal tubing under usual hot extrusion conditions, the extrusion ratio $\gamma$ is in the range of 4–30. Therefore, the plastic strain during extrusion is mostly in the range of 1.4–3.4.

A next important factor is the strain rate ($\dot{\epsilon}$) which is the plastic strain per unit time and which can be expressed by the following formula:

$$(\dot{\epsilon}) = \frac{\epsilon}{l_0/v} = \frac{v}{l_0} \ln \gamma$$

wherein v is the extrusion rate (mm/sec) and $l_0$ is the length of the billet (mm).

In the manufacture of metal tubing under usual hot extrusion conditions, the length of the billet ($l_0$) is 500–1200 mm, and the extrusion rate is 100–400 mm/sec. Therefore, the plastic strain rate ($\dot{\epsilon}$) is mostly in the range of 0.1–3.0 $sec^{-1}$.

Generally, the higher the processing temperature, i.e., the temperature of the material which is being processed, the lower the deformation resistance. The processing temperature is the temperature in Region II of FIG. 4. During actual manufacture, it is difficult to determine the temperature in Region II. However, it is rather easy to estimate the temperature in Region II on the basis of the temperature of the billet at the inlet of the container 10. Namely, usually the container 10 and the mandrel 11 have been preheated to about 100°–300° C. prior to extrusion. Upon extrusion, the hot billet 3 is cooled by the container 10 and mandrel 11, and it is estimated that a temperature drop of about 50° C. takes place until the billet 3 reaches the deformation area, i.e. Region II.

The deformation resistance can be determined as follows.

Figure 6:
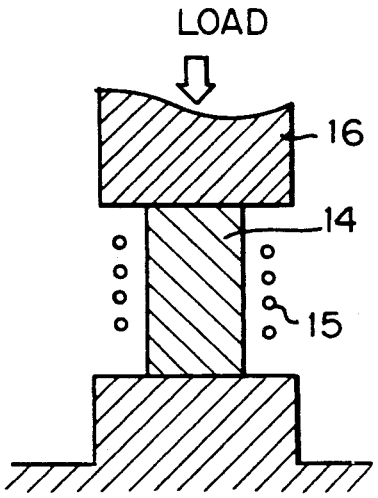
FIG. 6 is a view schematically illustrating a method of determining the relationship between load and plastic deformation under hot conditions.
Figure 7:
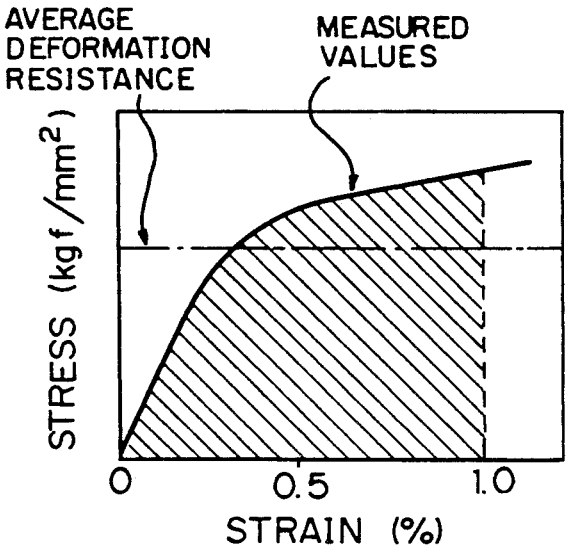
FIG. 7 is a stress-strain diagram which is used to calculate deformation resistance.

FIG. 6 illustrates an apparatus for performing a compression test at a given temperature to determine deformations and loads. In FIG. 6 a test piece 14 which has been heated by an induction coil 15 is subjected to deformation by a press 16. FIG. 7 shows a graph of the stress-strain relationship for the test piece 14, which was obtained by experiment as shown in FIG. 6.

Therefore, first a compression test is carried out at prescribed temperatures while applying a strain up to 1.0 at a given strain rate to obtain a stress-strain curve. Then, the deformation resistance is obtained by dividing the total area under the stress-strain curve, i.e., the hatched area in FIG. 7, by the final strain to determine the average deformation resistance. This value is called the "deformation resistance". The strain rate can be determined on the basis of the time required until the strain reaches 1.0.

Figure 8:
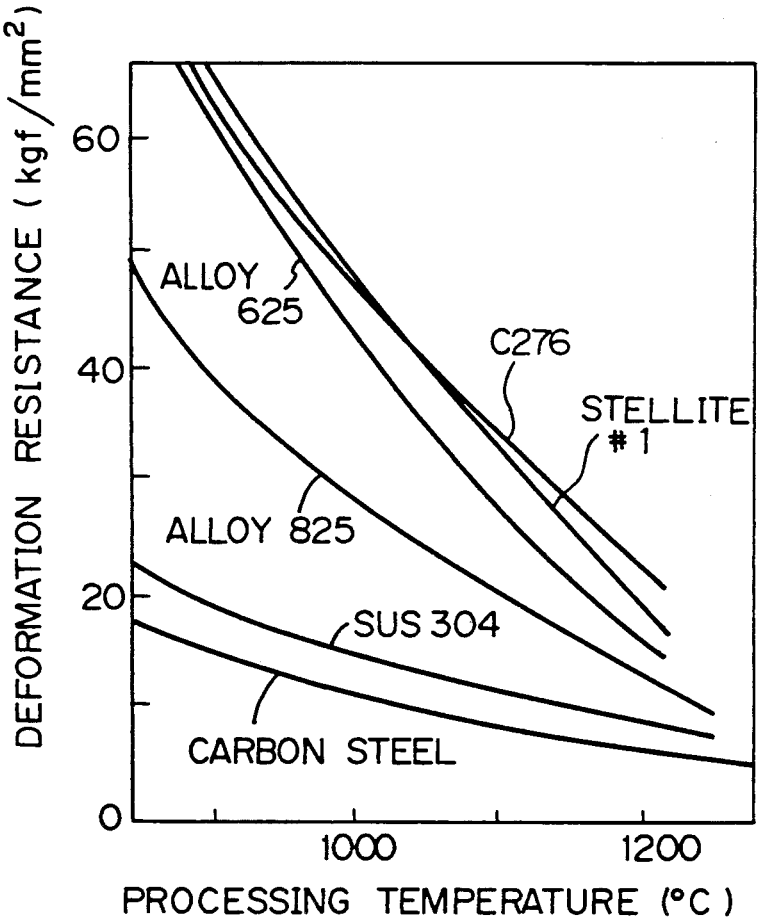
FIG. 8 is a graph showing the relationship between deforming temperature and deformation resistance for various metals.

FIG. 8 shows the relationship between the deformation resistance which is determined in the manner described above and the processing temperature for carbon steel (JIS STKM 19), stainless steel (JIS SUS-304), nickel-base alloys (Alloy 825, Alloy 625, C276), and a cobalt-base alloy (Stellite #1). The chemical composition of each is shown in Table 1.

TABLE 1

| | (% by weight) | | | | | | |
|---|---|---|---|---|---|---|---|
| Alloy | Cr | Ni | Fe | Mo | C | Co | Others |
| Alloy 625 | 21.5 | Bal. | 4.5 | 9.0 | 0.01 | — | Nb 3.5 |
| Alloy 825 | 21.0 | 42.0 | Bal. | 3.0 | 0.01 | — | Cu 2.0 |
| SUS 304 | 19.0 | 9.0 | Bal. | — | 0.05 | — | |
| C 276 | 15.0 | Bal. | 5.0 | 16.0 | 0.005 | — | W 4.0 |
| Stellite #1 | 32.0 | 2.0 | 2.0 | — | 2.5 | Bal. | W 12.0 |
| Carbon Steel | 0.05 | 0.1 | Bal. | — | 0.08 | — | Cu 0.2, Mn 1.1, Nb 0.02 |

As shown in FIG. 8, the deformation resistance of the nickel-base alloys and the cobalt-base alloy was extremely high in comparison with that of carbon steel and stainless steel. This means that nickel and cobalt-base alloys are hard to work even at high temperatures.

For example, when the processing temperature during deformation, i.e., the billet temperature in Region II of FIG. 4 is 1100° C., the deformation resistance is 9.4 kgf/mm$^2$ for carbon steel and 14.0 kgf/mm$^2$ for SUS 304. Therefore, the ratio of deformation resistance of these two metals is about 1.5. On the other hand, the deformation resistance of a nickel-base alloy (Alloy 825) is 27.5 kgf/mm$^2$ at 1100° C., and the ratio of deformation resistance of Alloy 825 to that of the carbon steel is about 2.9.

One of the main causes of the formation of cracks in the cladding layer in the manufacture of clad tubing of carbon steel and a nickel-base alloy but not in the manufacture of clad tubing of carbon steel and stainless steel is that the deformation resistance ratio for the former type of tubing is higher than for the latter. Thus, since the ratio of deformation resistance of the cladding material (a nickel-base alloy) to the deformation resistance of the parent material (carbon steel) is high, material flow during deformation is quite different for the two materials. As a result, at first the layer of the material having lower resistance to deformation flows preferentially to that having a high resistance to deformation. Then, plastic flow of the material having a high deformation resistance will follow because the material is forced to move towards the extrusion die with an increase of extrusion pressure, which will disturb the plastic flow of the material having a lower deformation resistance. Deformation of the two different types occurs alternately, resulting in a periodic change in the wall thickness of the cladding layer during deformation. In addition, the nickel-base alloy has a high deformation resistance and is hard to work. Ultimately, therefore, joint-like cracks occur in the cladding layer, i.e., the nickel-base alloy layer.

The inventors of the present invention have carried out a series of experiments to discover the main cause of this type of wave-like fluctuation in the wall thickness of a cladding layer and the formation of joint-like cracks. They found critical conditions for preventing such defects on the surface of the cladding layer.

Figure 9:
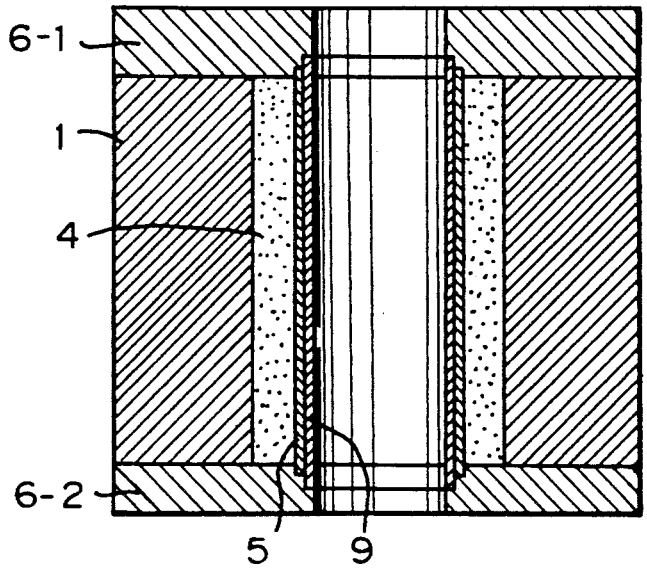
FIG. 9 is a sectional view of a billet used in an experiment.

FIG. 9 is a sectional view of a combined billet which was used in the above-described experiment. As shown, a blank pipe 1 of wrought carbon steel (parent layer) having a chemical composition shown in Table 1 (JIS STKM 19) and a thin-walled capsule 5 of mild steel were disposed concentrically. The bottom ends of the blank pipe 1 and capsule 5 were closed by an end plate 6-2. A powder of a nickel-base alloy having the chemical composition shown in Table 1 as Alloy 625 was poured into the annular space between the blank pipe 1 and the capsule 5. The top ends of the blank pipe 1 and capsule 5 were sealed by an end plate 6-1 to provide a combined billet having multiple layers. A heat-insulating cover tube 9 was used so as to maintain the nickel-base alloy powder layer 4 at a high temperature.

A plurality of such billets were prepared. Each billet was subsequently heated under one of the following conditions and then hot extruded.

(1) Billet I:

This billet was heated uniformly throughout. That is, the processing temperature was the same for the parent pipe 1 and the powder-packed layer 4.

(2) Billet II:

In this case, the powder-packed layer 4 was heated to a higher temperature than was the parent pipe 1 so that the processing temperature of the former was about 50° C. higher than that of the blank pipe 1.

(3) Billet III:

This billet was heated so that the processing temperature of the powder-packed layer 9 was about 100° C. higher than that of the blank pipe 1.

When a temperature difference is established between the powder-packed layer and the parent pipe, there appears a temperature gradient from the inside of the billet (at high temperatures) toward the outside of the billet (at low temperatures). The term "temperature difference" herein means the temperature difference between the center of the wall thickness of the powder-packed layer and the center of the wall thickness of the blank pipe. In addition, the processing temperature is the temperature of the billet at a position just upstream of the extrusion die, i.e., the temperature in the deformation region (Region II).

The processing temperature was determined as follows.

First, the temperatures in each of the sections of the heated billet were determined by using a thermocouple embedded in the billet just before introducing the billet into the container. Then, the temperature drop due to the heat absorbed by the container and mandrel (each preheated to about 100°~300° C.) was calculated and was subtracted from the starting temperature. The temperature drop in this case, as already mentioned, was about 50° C.

Table 2 summarizes the results of the above-mentioned tests, including the processing temperatures of the blank pipe and the powder-packed layer, and the ratios of deformation resistance for each combination of materials.

TABLE 2

| Processing Temperature of Blank Pipe (°C.) | Processing Temperature of Powder-Packed Layer (Alloy 625) (°C.) | | | | |
|---|---|---|---|---|---|
| | 1000 | 1050 | 1100 | 1150 | 1200 |
| 1200 | — | — | — | — | 2.3 |
| 1150 | — | — | — | 2.8 | 2.0 |
| 1100 | — | — | 2.9 | 2.3* | 1.7 |
| 1050 | — | 3.5 | 2.7 | 2.1* | 1.5 |
| 1000 | 3.8 | 3.0 | 2.3* | 1.8* | 1.3 |

In Table 2, the symbol "*" indicates the case in which the extruded tubing was free from joint-like defects.

Figure 10:
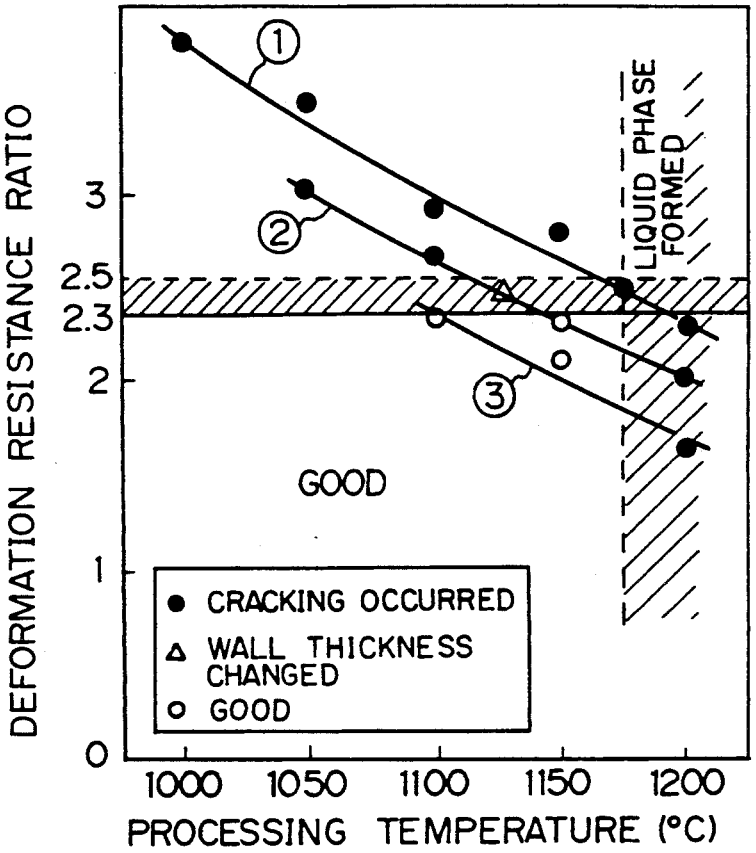
FIG. 10 is a graph showing test results in which the effects of the ratio of deformation resistance of the parent pipe material and the cladding pipe material as well as the deformation temperature were determined on the occurrence of joint-like cracks.

FIG. 10 is a graph showing the relationship between the formation of joint-like defects and the temperature of the powder-packed layer, the difference between the processing temperatures of the blank pipe and the powder-packed layer, and the ratio of the deformation resistance of the powder-packed layer to that of the blank pipe. In the graph, the symbol "○" indicates the case in which the wall thickness of the cladding layer did not change to any substantial degree and there was no cracking. The symbol "Δ" indicates the case in which there were some changes in the wall thickness as well as slight cracking, which could be easily removed by additional treatment. The symbol "●" indicates the case in which there occurred serious defects such as cracking which could not be remedied.

When the temperature difference between the blank pipe and the powder-packed layer was zero, i.e., the billet was uniformly heated as shown by Curve (1) of FIG. 10, joint-like defects appeared in the nickel-base alloy layer, i.e., the cladding layer for a processing temperature of either 1100° C. or 1200° C. When the processing temperature is about 1200° C., the heating temperature of the billet is supposed to be 1250° C. and the nickel-base alloy has been heated to its solidus line. Therefore, in this case the cracking was mainly caused by a reduction in ductility due to the partial formation of a liquid phase, and was not due to the ratio of the deformation resistance, which was 2.3, as shown in Table 2.

In contrast, as shown by Curve (2) of FIG. 10, when the processing temperature of the powder-packed layer was increased by 50° C. above that of the blank pipe, joint-like defects occurred with a processing temperature of about 1050° C. (the processing temperature of the blank pipe was about 1000° C.). However, when the processing temperature was about 1150° C., there were no substantial joint-like defects, and the stable manufacture of the clad tubing could be performed. The reason why joint-like defects occurred at a processing temperature of about 1050° C. for the blank pipe is that the deformation resistance of the powder-packed layer was about 3 times as high as that of the blank pipe. When the processing temperature of the nickel-base alloy layer was about 1150° C., the deformation resistance was about 21.7 kgf/mm$^2$ for Alloy 625 as indicated in FIG. 8. On the other hand, when the processing temperature of the carbon steel layer was about 1100° C., and about 50° C. lower than that of the nickel-powder packed layer, the deformation resistance was about 9.4 kgf/mm$^2$ as indicated in FIG. 8. Thus, the ratio of the deformation resistance fell to about 2.3. This is why joint-like defects did not occur.

As shown by Curve (3) of FIG. 10, when the processing temperature of the powder-packed layer was 100° C. higher than that of the blank pipe, joint-like defects did not occur even at a processing temperature of about 1100° C., and at a processing temperature of about 1150° C., there were no substantial joint-like defects, so that stable extrusion of the clad tubing could be performed. In this case, the ratio of the deformation resistance of the powder-packed layer to that of the parent pipe was about 2.3 and 2.1, respectively.

In the case indicated by the symbol "Δ" in FIG. 10 there was some fluctuation in the wall thickness as well as formation of joint-like defects, which were remediable. The ratio of deformation resistance was 2.3–2.5.

The above experiments were repeated for other combinations of the blank pipe and the powder-packed layer by varying the types of metals. It was confirmed that as long as hot extrusion is applied to a billet in which the temperature of the blank pipe layer which has a higher resistance to deformation (usually this is the cladding layer) is adjusted so as to be higher than the temperature of the other blank pipe, the fluctuation in the wall thickness of the cladding layer and the formation of joint-like defects can be diminished, and sometimes can be prevented successfully, even if the metal is a wrought metal or a powder-packed layer.

Regarding the temperature difference, it is preferred that the temperature of one of the layers of the billet, which has higher resistance to deformation, be raised by 50° C. or more above the temperature of the other layer. Although the specific temperature difference depends on the particular combination of metals, a temperature difference of at least 50° C. is required.

The purpose of creating such a temperature difference is to adjust the ratio of deformation resistance of the two metals during extrusion to be 2.5 or less, and preferably 2.3 or less.

As is apparent from Table 2 and FIG. 10, as long as the ratio of deformation resistance of the two metals is adjusted to be 2.5 or less, the formation of joint-like defects can be prevented successfully, provided that there is no formation of a liquid phase. If other defects are formed to an extent, they are slight. In addition, when the ratio is adjusted to be 2.3 or less, the joint-like defects can be prevented almost entirely, and fluctuations in the wall thickness of the cladding layer as well as the parent base layer can be reduced to an extremely low level.

As is apparent from the data shown in FIG. 8, there is a general tendency that the higher the processing temperature, the smaller the difference in deformation resistance. Thus, if the heating temperature for the combined billet increases, the deformation resistance of nickel-base alloys and cobalt-base alloys will rapidly decrease, and the ratio of the deformation resistance of the nickel-base or cobalt-base alloy to that of the carbon steel will also decrease. However, if the temperature is raised excessively, i.e., beyond the solidus line of the metal having a lower melting point, a liquid phase appears, resulting in the above-mentioned defects. In addition, raising the temperature will require additional heat, and an increase in energy costs and scale loss of the billet will be inevitable. Degradation in material properties of the clad tubing product as well as marked damage to the extrusion die also occurs frequently.

Therefore, it is desirable that the blank pipe of the metal having lower resistance to deformation be kept at as low a temperature as possible, and the other blank pipe having a higher deformation resistance be kept at a higher temperature than the first blank pipe. In this connection, a further explanation on deformation resistance will be made with reference to FIG. 8. In the case, for example, in which carbon steel is heated to 1100° C. and Alloy 625 is heated to 1150° C., the deformation resistance of the two metals is 9.4 kgf/mm$^2$ and 21.7 kgf/mm$^2$, respectively, and the ratio of deformation resistance is 2.3. Therefore, such thermal conditions should be achieved in the billet prior to extrusion.

In the case of the combination of carbon steel or low alloy steel with nickel-base alloys, the ratio of deformation resistance can be adjusted to be 2.3 or less by setting the temperature of the nickel-base alloy layer at the center of the wall thickness to be about 50° C. or more higher than the temperature of the carbon steel or low alloy steel layer at the center of the wall thickness.

It is advantageous to provide such a temperature difference even for a combination of metals which exhibit the deformation resistance ratio of 2.5 or less, or 2.3 or less at an extrusion temperature. Namely, the lower the processing temperature, the more the properties of the clad tubing product are improved due to the formation of a preferred metallographical structure. Therefore, if two types of metals both having a deformation resistance ratio of 2.3 or less are used to assemble a billet, it would be advisable to set up a temperature difference between the two metals in order that pipe forming can be carried out at a lower temperature, whereby product properties can be further improved, and heating energy can be reduced.

Furthermore, it is possible to greatly reduce the fluctuation in wall thickness by creating a temperature difference between the two types of metals which constitute an extrusion billet so as to make the difference in deformation resistance to be as small as possible. For example, at 1100° C., the ratio of the deformation resistance of Alloy 825 to that of carbon steel is 2.3, and joint-like defects do not occur even if the deformation is carried out at the same temperature for both metals, i.e., with no temperature difference being applied to the two types of metals. However, if the Alloy 825 layer is heated to a higher temperature to reduce the deformation resistance thereof down to that of carbon steel, metal clad tubing can be produced which has improved properties and which is almost completely free from fluctuations in wall thickness.

The manufacturing process of the present invention can be applied to a method of manufacturing tubing which comprises assembling a combined billet from two blank pipes each made of different types of wrought metals, and hot extruding the combined billet after heating. For example, as shown in FIG. 1, the blank pipes 1 and 2 are respectively made of carbon steel and hard-to-work materials such as nickel-base alloys, cobalt-base alloys, titanium or titanium-base alloys, composite materials mainly comprising intermetallic compounds, and carbides and nitrides of metals, which have a deformation resistance higher than that of carbon steel. The combined billet 3 is prepared by concentrically combining these two blank pipes 1 and 2. Before being subjected to hot extrusion, the blank pipe which is manufactured from a hard-to-work material is heated to a temperature at least 50° C. higher than the temperature of the carbon steel layer. Therefore, fluctuations in the wall thickness of the hard-to-work material layer (usually the cladding layer) as well as joint-like cracks can be successfully suppressed.

A few examples of practical methods of providing the temperature difference between the two types of metals which constitute a combined billet are as follows:

(i) By adjusting the frequency of high-frequency induction heating such that the hard-to-work metal layer is heated to a higher temperature than is the easy-to-work metal layer.

(ii) By adjusting the direction of heating of gas-burners in a gas-heated furnace such that the hard-to-work metal layer can be heated to a temperature higher than is the easy-to-work metal layer.

(iii) After heating a combined billet uniformly in a high-frequency induction furnace, a gas-heated furnace, an electric furnace, etc., the easy-to-work metal layer having a lower deformation resistance is cooled to a temperature lower than that of the hard-to-work metal layer. The cooling can be performed, for example, by spraying a cooling medium such as water, inert gas, air, etc. against the surface of the easy-to-work metal layer.

In order to supplement the effect of the methods mentioned above, a heat-isolating covering pipe 9 as shown in FIGS. 3 and 9 may be used. This is because the heated billet is cooled during extrusion upon contact of a mandrel with the inner surface of the heated billet. Therefore, if the powder-packed layer is heated to a temperature higher than that of the parent blank pipe 1, the temperature difference would disappear at the area of deformation. A heat-isolating covering pipe is effective for maintaining the temperature difference. It is also effective to suppress a temperature drop of the powder-packed layer so as to avoid the formation of defects caused by a temperature drop. When the powder-packed layer is placed on the outer side of the combined billet, the covering pipe 9 is naturally also placed on the outside of the powder-packed layer.

The heat-insulating covering pipe 9 may have a double or multi-walled structure made of two or more metal (carbon steel) sheets. Preferably, a material having a small heat transfer coefficient is provided between the sheets.

The heat-insulating covering pipe may be in the form of a pipe having two or more walls between which a heat-isolating material is disposed. Some examples of the heat-isolating material are metal oxides such as oxides of iron, titanium, silicon, or aluminum, metallic nitrides, and mixtures thereof. Nonmetallic heat-isolating materials can also be employed, such as bricks. The heat-isolating material can be packed between the walls in the form of a powder, or it can be in the form of a layer which is chemically or mechanically bonded to the surfaces of the walls.

In one example of the present invention, a heat-insulating pipe is prepared from a low-carbon steel pipe. A heat-isolating material mainly comprising an iron oxide is provided on the outer surface of the pipe, and the pipe is then inserted into a second low carbon steel pipe having a larger diameter. The resulting assembly is subjected to slight drawing to produce a double-walled steel pipe which can be used as a heat-insulating covering pipe.

In order to control the temperature difference between each of the layers which constitute a combined billet, it is necessary to previously determine the relationship between the heating temperature and the processing temperature during extrusion for each of various sizes of billets by performing experimental heating. The temperature can be determined by using a thermocouple which has been embedded in each of the layers at the center of the wall thickness. On the basis of such a previously determined relationship between the heating temperature and the processing temperature, a desired temperature difference can be established between each of the layers of the billet simply by controlling the heating temperature of the billet.

As already mentioned, it is desirable to set the temperature difference to be 50° C. or more. Such a temperature difference may be obtained by controlling the temperature difference either at the billet heating step, at the inlet for a billet just before the container of an extrusion apparatus, or in the region of deformation mentioned above. Ideally, the temperature difference should be obtained by controlling the temperatures in the region of deformation. However, during actual manufacture, it is quite difficult to do so. Therefore, since a temperature difference of 50° C. or more at the inlet of the container will be maintained even in the region of deformation, it is practical to control the temperature difference at the inlet of the container.

The heating temperature should be determined by considering the kind of metal, the temperature drop before the metal reaches the deformation region, and other factors. For example, in the case of nickel-base alloys the heating temperature is preferably in the range of 1000°–1250° C., and the carbon steel layer to be combined therewith is heated to a temperature at least 50° C. lower than that of the nickel-base alloy.

The process of the present invention is more advantageous from the view point of industry when at least one of the layers which constitute a combined billet comprises a powder-packed layer. In this case it is desirable to apply CIP (cold isostatic press) to an assembled billet prior to heating it so as to further compact the powder-packed layer.

Usually, a metal powder is poured into an annular space between a blank pipe and a capsule. However, even when the pouring is carried out while vibrating the space, the apparent density of the packed layer is at most 70% with respect to the true density. This means that the reduction in thickness during extrusion is large, resulting in a frequent occurrence of large fluctuations in the wall thickness of the cladding layer. A small degree of nonuniformity in the temperature in the powder-packed layer, will further increase the fluctuations in the wall thickness. Furthermore, when there is much shrinkage of the powder packed layer during extrusion, a thin-walled metal tube surrounding the powder-packed layer may buckle to form wrinkles which will be starting points of joint-like defects.

When CIP is applied, the apparent density of the powder-packed layer is increased to about 80% of the true density. In this case, the above-mentioned disadvantages which are caused by a low apparent density can be successfully prevented with an improved yield of the product. In addition, the product and billet designs are simplified.

Another advantage of applying CIP is that the efficiency of induction heating is increased due to the high density of the powder layer. If there are many pores in the powder-packed layer, it has a high electrical resistance and a low thermal conductivity. Therefore, during induction heating, heat generation per unit input of power is small. Increasing the density of the powder-packed layer by CIP overcomes this problem. Especially, when induction heating is used to heat the powder-packed layer to a temperature higher than usual, the energy efficiency can be improved and shortening of the heating can be achieved with an increase in productivity.

As shown in FIG. 3 the billet may comprise two powder-packed layers which are of different types of metals. Metal powders which may be used in the present invention are preferably made by a gas-atomization process, since particles obtained by gas-atomization are round and are closely packed.

In view of the product properties, it is preferable to use particles with a low content of gaseous components, such as oxygen.

As mentioned above, seamless tubing comprising a parent layer of carbon steel or low alloy steel and a cladding layer of a nickel-base alloy has a variety of applications including line piping for oil, boiler tubing, and piping for use in chemical plants having improved resistance to corrosion.

The process of the present invention will be further described in conjunction with some working examples for making such clad metal tubing.

EXAMPLE 1

Figure 11:
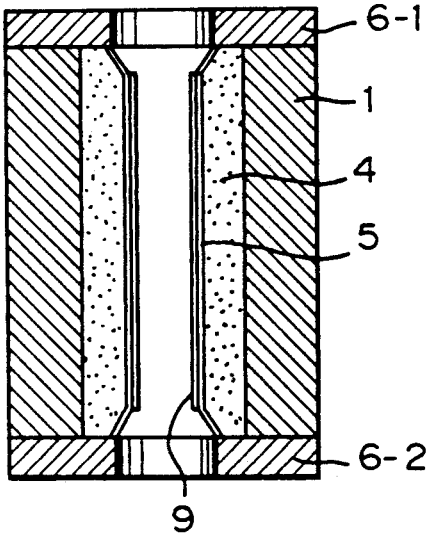
FIGS. 11, 12, 13, and 14 are vertical, sectional views of combined billets which were used in the working examples of the present invention.

(I) As shown in FIG. 11, a hollow cylindrical blank pipe 1 of wrought carbon steel (0.08% C-0.35% Si-1.5% Mn-Fe) measuring 208 mm in outer diameter and 150 mm in inner diameter was prepared. A capsule 5 of low carbon steel (C:0.004%) measuring 77.3 mm in inner diameter and 3 mm in wall thickness was placed concentrically within the parent blank pipe 1. The bottom ends of each of the blank pipe 1 and the capsule 5 were sealed with an end plate 6-2 made of a material corresponding to JIS SS41. The dimension of the capsule 5 was designed to have allowances for compensating for outward expansion which occurred during cold isostatic pressing which will be described later.

A powder of Alloy 625 (21% Cr-8% Mo-3.4% Nb-62% Ni-4% Fe) which was atomized with argon gas and which had a particle size of 250 μm or less was packed within the annular space between the blank pipe 1 and the capsule 5, and then an end plate 6-1 was placed on the top ends of the blank pipe 1 and the capsule 5. After evacuating to a vacuum of $10^{-3}$ Torr, the annular space was completely sealed. A heat-isolation covering tube 9 of SS41 steel measuring 1 mm thick, the outer surface of which had been oxidized slightly to form a heat-resistant layer, was fixed to the inside of the capsule 5 to form a combined billet. The compacted density of the powder-packed layer was 73% with respect to the true density. In order to further increase the compact density, the billet was subjected to cold isostatic pressing at 5000 atms for 2 minutes. On the basis of the weight and volume of the billet after the isostatic pressing the density of the thus compacted powder layer was determined to be 82% of the true density.

The combined billet was then heated for about 1.5 hours in a gas-heated furnace at 1000° C. The heated billet was introduced into an induction coil heater in order to heat the outer shell of the billet to 1170° C. at the center of the thickness. The powder-packed layer of Alloy 625 was heated to 1230° C. by suitably adjusting the input frequency to the induction coil. After finishing heating, the billet was subjected to hot extrusion using an extrusion ratio of 11 at an extrusion rate of 110 mm/sec to form clad tubing measuring 100 mm in outer diameter, and 79 mm in inner diameter. The wall thickness of the cladding layer was 3.4 mm.

During extrusion the temperature at the center of the wall thickness in the deformation region was estimated to be 1120° C. for the blank pipe and 1180° C. for the powder-packed layer. Therefore, the deformation resistance ratio was determined to be 2.2 in accordance with the graph shown in FIG. 8.

The extruded clad tubing was treated by pickling to remove the capsule. The outer and inner surfaces were investigated macro- and microscopically for surface defects. It was confirmed that there were no surface defects such as cracking. Ultrasonic inspection was also carried out to determine the fluctuation in wall thickness for the cladding layer. The fluctuation was within ±5% with respect to the average wall thickness.

(II) The same billet as in (I) was heated such that the outer shell of the billet was heated to 1125° C. at the center of the thickness and the powder-packed layer was heated to 1175° C. The heated billet was then subjected to hot extrusion.

During extrusion the temperature at the center of the wall thickness in the region of deformation was estimated to be 1075° C. for the blank pipe and 1125° C. for the powder-packed layer. From FIG. 8 the deformation resistance ratio of the powder-packed layer with respect to the parent blank pipe was determined to be about 2.4. In this case there was some deviation in cross-sectional shape in the cladding layer, which could, however, be remedied by further treatment such as machining and grinding.

(III) As a comparative example, the compacted billet obtained in (I) was heated at 1000° C. for 1.5 hours and was introduced into an induction heating furnace to uniformly heat the parent blank pipe and the powder-packed layer at 1200° C. The thus-heated billet was subjected to hot extrusion under the same conditions as before. In this case the temperature of the whole billet was estimated to be about 1150° C. during deformation. The ratio of deformation resistance for the outer and inner shells was determined to be about 2.8 on the basis of the graph shown in FIG. 8. In this case, during extrusion a wide fluctuation in extrusion pressure was experienced. Inspection of the resulting clad tubing revealed that there was a remarkable fluctuation in the wall thickness of the cladding layer with unrepairable joint-like defects at intervals of about 300 mm.

EXAMPLE 2

Figure 12:
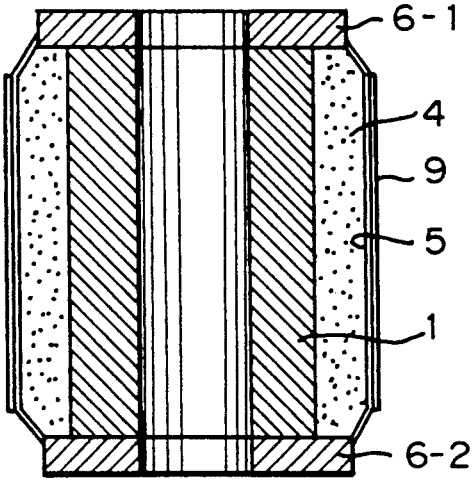

(I) As shown in FIG. 12, a hollow cylindrical parent pipe 1 of wrought carbon steel (0.45% C) measuring 143 mm in outer diameter and 62 mm in inner diameter was prepared. A capsule 5 of low carbon steel (C: 0.004%) measuring 177 mm in outer diameter and 4 mm in wall thickness was placed concentrically around the blank pipe 1. The bottom ends of the blank pipe 1 and capsule 5 were sealed with an end plate 6-2 made of a material corresponding to JIS SS41. The capsule 5 was provided with an allowance for shrinkage for the same reasons as mentioned before.

A stellite powder #6 (31% Cr-4% W-1.1% C-1% Si-56% Co) which was atomized with nitrogen gas and which had a particle size of 125 μm or less was packed within the annular space between the blank pipe 1 and the capsule 5, and then an end plate 6-1 was placed on the top ends of the blank pipe 1 and the capsule 5. The billet was evacuated and completely sealed. A heat-isolation covering tube 9 of SS41 steel measuring 1 mm in thickness and having a coating layer of boron nitride powder was placed around the outside of the capsule 5 to form a combined billet.

The compact density of the powder-packed layer was 68% with respect to the true density. In order to further increase the compact density, the billet was subjected to cold isostatic pressing at 5000 atms for 2 minutes. On the basis of the weight and volume of the billet after the isostatic pressing, the density of the thus-compacted powder layer was determined to be 79%.

The combined billet was then heated for about 2.0 hours in a gas-heated furnace at 1170° C. In order to establish a temperature difference between the parent blank pipe 1 and the powder-packed layer 4 of the combined billet, a jet of water under high pressure was directed against the inner surface of the billet for 12 seconds just prior to hot extrusion.

Extrusion was carried out using an extrusion ratio of 9.1 and an extrusion rate of 125 mm/sec to form clad tubing measuring 81 mm in outer diameter, and 59 mm in inner diameter. The wall thickness of the cladding layer was 2.1 mm.

During deformation the material temperature at the center of the wall thickness was estimated to be 1030° C. for the parent blank pipe (carbon steel) and 1120° C. for the powder-packed layer on the basis of pretest results in which the temperatures of various portions of the billet were measured. The ratio of deformation resistance was about 2.2. The resulting clad tubing was free from any surface defects. (II) As a comparative example, a combined billet compacted by cold isostatic pressing as in (I) was heated to 1150° C. in a gas-heated furnace. The combined billet comprising a uniformly-heated parent blank pipe and a powder-packed layer was subjected to hot extrusion under the same conditions as before. Inspection of the resulting clad tubing revealed that there was a remarkable fluctuation in wall thickness for the cladding layer with unrepairable joint-like defects at intervals of about 300 mm.

The deformation ratio was determined to be about 2.9.

EXAMPLE 3

Figure 13:
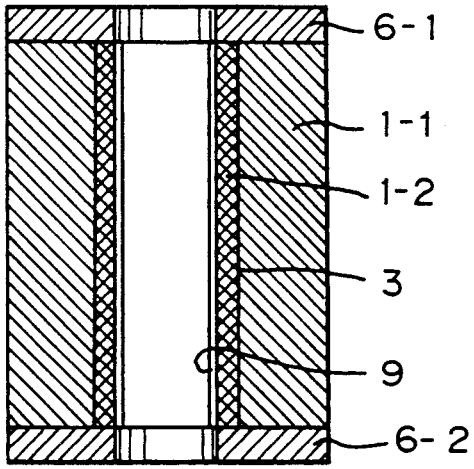

As shown in FIG. 13, a blank pipe 1-1 of a low alloy wrought steel (0.1% C-2.2% Cr-0.9% Mo) measuring 250 mm in outer diameter and 125 mm in inner diameter was prepared. A hollow cylindrical member, i.e., cladding blank pipe 1-2 of wrought Alloy C276 (15% Cr-5% Fe-16% Mo-4% W-58% Ni) measuring 124 mm in outer diameter and 105 mm in inner diameter was disposed within the blank pipe 1-1 to make an assembly. End plates 6-1 and 6-2 of JIS SUS 304 were placed on both ends of the assembly. After evacuating the annular space between the blank pipe 1-1 and the cladding blank pipe 1-2 to $10^{-3}$ Torr the assembly was sealed by welding the end plates. A heat-isolating covering tube 9 of SUS 304 measuring 4 mm in wall thickness, the outer surface of which had been slightly oxidized to form a heat-isolating layer, was fixed to the inside of the cladding blank pipe 1-2 to form a combined billet for extrusion.

The combined billet was then heated for about 1.5 hours in a gas-heated furnace at 1100° C. The heated billet was introduced into an induction coil heater so that the outer shell of the billet was heated to 1180° C. at the center of the thickness and the cladding inner blank pipe was heated to 1230° C. by means of suitably adjusting the supplying frequency to the induction coil. After spraying water against the outer surface of the billet for about 15 seconds, the heated billet was worked by hot extrusion using an extrusion ratio of 7.3 at an extrusion rate of 110 mm/sec to form clad tubing measuring 128 mm in outer diameter, and 94 mm in inner diameter. The wall thickness of the cladding layer was 3.4 mm.

During extrusion the temperature at the center of the wall thickness was estimated to be 1050° C. for the parent pipe, and 1190° C. for the cladding pipe in the region of deformation due to the insulating effectiveness of the thick-walled heat-isolating covering tubing 9, which was made of SUS 304. Therefore, the deformation resistance ratio was determined to be about 2.3.

The outer and inner surfaces of the extruded clad tubing were investigated for surface defects in the same manner as in Example 1. There were no surface defects such as cracking.

EXAMPLE 4

Figure 14:
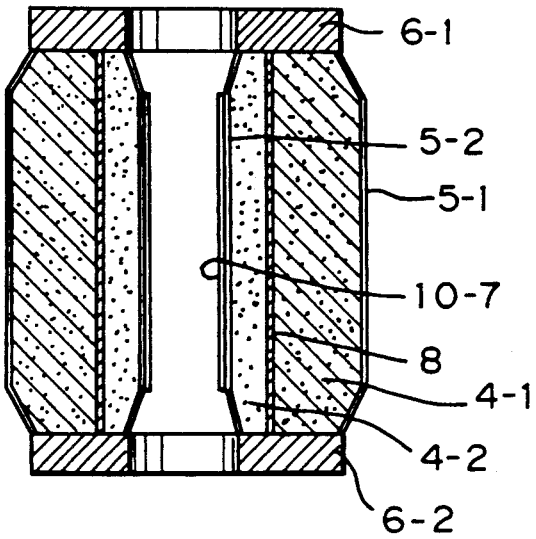
Figure 15:
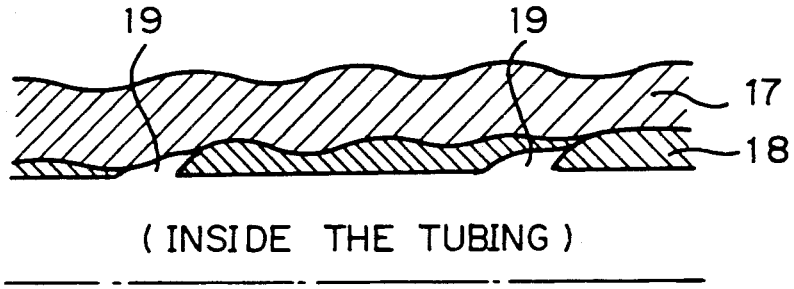
FIG. 15 is a partial sectional view of clad metal tubing illustrating wavy fluctuations in wall thickness and joint-like cracks.

(I) As shown in FIG. 14, an outer capsule 5-1 of SS41 steel measuring 218 mm in outer diameter and 1.6 mm in wall thickness, a cylindrical partition wall 8 of a low carbon steel (C: 0.004%) measuring 143 mm in outer diameter and 1 mm in wall thickness, and an inner capsule 5-2 of low carbon steel (C: 0.004%) measuring 68 mm in inner diameter and 3 mm in wall thickness were placed concentrically with each other to form an assembly. The bottom end of the assembly was closed with an end plate 6-2 made of SS41 steel. The inner and outer capsules each had inward and outward dimensional allowances for compensating for outward and inward shrinkages, respectively, which occurred during the cold isostatic pressing which will be described later.

Into the annular space between the outer capsule 5-1 and the partition wall 8, a powder 4-1 of carbon steel (0.08% C- 0.3% Si-1.5% Mn-Fe) which was atomized with water and had a particle size of 100 μm or less was packed. Into the annular space between the inner capsule 5-2 and the partition wall 8, a powder 4-2 of Alloy 625 (21% Cr-8% Mo-3.4% Nb-62% Ni-4% Fe) which was atomized with argon gas and had a particle size of 250 μm or less was packed. After the completion of packing, an end plate 6-1 of SS41 steel was placed on the top ends of the capsules 5-1 and 5-2 and the partition wall 8. After evacuating the assembly to $10^{-3}$ Torr, the assembly was sealed. A heat-isolation covering tube 10-7 was fixed to the inside of the capsule 5-2 to form a combined billet. The compact density of the powder-packed layer with respect to the true density was 65% for the carbon steel powder and 74% for the Alloy 625 powder. In order to further increase the compact density the billet was subjected to cold isostatic pressing at 5000 atms for 2 minutes to give the compact density of 78% and 82%, respectively.

The combined billet was then heated for about 2 hours in a gas-heated furnace at 1000° C. The heated billet was introduced into an induction coil heater in order to heat the outer carbon steel powder shell of the billet to 1170° C. at the center of the thickness and the inner Alloy 625 powder shell to 1230° C. by means of suitably adjusting the input frequency to the induction coil. After the completion of heating, the billet was subjected to hot extrusion using an extrusion ratio of 11 at an extrusion rate of 115 mm/sec to form clad tubing measuring 97 mm in outer diameter, 75 mm in inner diameter, and 9 mm in wall thickness.

During deformation the temperature at the center of the wall thickness was estimated to be 1120° C. for the carbon steel powder shell, and 1180° C. for the Alloy 625 powder shell.

The deformation resistance ratio for the two layers was determined to be 2.2.

The outer and inner surfaces of the extruded clad tubing were inspected for surface defects in the same manner as in Example 1. There were no surface defects such as cracking. (II) A billet was prepared which was the same as the billet in (I) except that the outer diameter of the outer capsule was 208 mm and cold isostatic pressing was not supplied. The resulting billet was hot worked under the same conditions as described above to prepare clad tubing of the same dimensions.

Ultrasonic inspection was carried out to determine the fluctuation in wall thickness for the cladding layer. The fluctuation was in general within ±2.5% of the average wall thickness. However, there were large wrinkles at the end portions of the tubing. Since these end portions were cut off, the yield of the product was 95%. However, there were no joint-like defects.

In this case, since cold isostatic pressing was not carried out, the thermal conductivity was small. Therefore, it took much time to heat the combined billet to a predetermined temperature. In addition, there was a tendency for the outer side of the billet to be heated to a higher temperature than the inner surface. Therefore, in comparison with clad tube having been subjected to cold isostatic pressing, heating was applied for 1.5 times as long at a rather small input of power.

What is claimed is:

1. A process for manufacturing clad metal tubing from two different types of metals having different deformation resistances, which comprises:

preparing a billet comprising a first pipe having a first deformation resistance and a second pipe having a second deformation resistance, the second deformation resistance being greater than the first deformation resistance, the first and second pipes being arranged concentrically with each other and the pipes being made of different metals, heating the billet;

adjusting heating temperatures of the first and second pipes such that the second pipe is at a higher temperature than the first pipe; and applying hot extrusion to the billet while maintaining the heating temperatures of the first and second pipes such that the second pipe is at a higher temperature than the first pipe.

2. A process for manufacturing clad metal tubing as set forth in claim 1, wherein the step of heating comprises heating the second pipe to a temperature 50° C. or more higher than the first pipe.

3. A process for manufacturing clad metal tubing as set forth in claim 2, wherein the step of heating comprises adjusting a temperature difference between the first and second pipes to provide a deformation resistance ratio of the first and second pipes in a deformation region during the hot extrusion of 2.5 or smaller.

4. A process for manufacturing clad metal tubing as set forth in claim 1, wherein the step of heating comprises heating the billet uniformly and then cooling the first pipe to a temperature 50° C. or more lower than the second pipe.

5. A process for manufacturing clad metal tubing as set forth in claim 4, wherein the step of heating comprises adjusting a temperature difference between the first and second pipes to provide a deformation resistance ratio of the first and second pipes in a deformation region during the hot extrusion of 2.5 or smaller.

6. A process for manufacturing clad metal tubing as set forth in claim 1, wherein the step of preparing the billet comprises preparing each of the first and second pipes from a wrought metal by machining.

7. A process for manufacturing clad metal tubing as set forth in claim 1, wherein the step of preparing the billet comprises preparing each of the first and second pipes from a powder-packed layer.

8. A process for manufacturing clad metal tubing as set forth in claim 7, further comprising subjecting the billet to cold isostatic pressing to increase compact density of each of the powder-packed layers prior to the hot extrusion step.

9. The process of claim 1, wherein a deformation resistance ratio of the first and second pipes is greater than 2.5 when the first and second pipes are at equal temperatures providing said equal temperatures are below temperatures at which a liquid phase of the metals comprising the first and second pipes is formed.

10. The process of claim 1, wherein the heating step comprises adjusting respective temperatures of the first and second pipes during the hot extrusion to temperatures below solidus lines of the metals comprising the first and second pipes.

11. The process of claim 1, wherein the heating step comprises adjusting respective temperatures of the first and second pipes during the hot extrusion to provide fluctuations in wall thickness of the second pipe after the hot extrusion of no greater than ±5% of an average wall thickness of the second pipe.

12. The process of claim 1, wherein the heating step comprises adjusting respective temperatures of the first and second pipes during the hot extrusion to provide fluctuations in wall thickness of the second pipe after the hot extrusion of no greater than ±2.5% of an average wall thickness of the second pipe.

13. A process for manufacturing clad metal tubing from two different types of metals having different deformation resistances, which comprises:

preparing a billet comprising a first pipe having a first deformation resistance and a second pipe having a second deformation resistance, the second deformation resistance being greater than the first deformation resistance, the first and second pipes being arranged concentrically with each other, the first pipe being prepared from a wrought metal by machining and the second pipe comprising a powder-packed layer disposed on an inner or outer surface of the first pipe, heating the billet;

adjusting heating temperatures of the first and second pipes such that the second pipe is at a higher temperature than the first pipe; and applying hot extrusion to the billet while maintaining the heating temperatures of the first and second pipes such that the second pipe is at a higher temperature than the first pipe.

14. A process for manufacturing clad metal tubing as set forth in claim 13, wherein the step of heating comprises heating the second pipe to a temperature 50° C. or more higher than the first pipe.

15. A process for manufacturing clad metal tubing as set forth in claim 14, wherein the step of heating comprises adjusting a temperature difference between the first and second pipes to provide a deformation resistance ratio of the first and second pipes in a deformation region during the hot extrusion of 2.5 or smaller.

16. A process for manufacturing clad metal tubing as set forth in claim 13, wherein the step of heating comprises heating the billet uniformly and then cooling the first pipe to a temperature 50° C. or more lower than the second pipe.

17. A process for manufacturing clad metal tubing as set forth in claim 16, wherein the step of heating comprises adjusting a temperature difference between the first and second pipes to provide a deformation resistance ratio of the first and second pipes in a deformation region during the hot extrusion of 2.5 or smaller.

18. A process for manufacturing clad metal tubing as set forth in claim 13, further comprising subjecting the billet to cold isostatic pressing to increase compact density of the powder-packed layer prior to the hot extrusion step.

19. The process of claim 13, wherein a deformation resistance ratio of the first and second pipes is greater than 2.5 when the first and second pipes are at equal temperatures providing said equal temperatures are below temperatures at which a liquid phase of the metals comprising the first and second pipes is formed.

20. The process of claim 13, wherein the heating step comprises adjusting respective temperatures of the first and second pipes during the hot extrusion to temperatures below solidus lines of the metals comprising the first and second pipes.

21. The process of claim 13, wherein the heating step comprises adjusting respective temperatures of the first and second pipes during the hot extrusion to provide fluctuations in wall thickness of the second pipe after the hot extrusion of no greater than ±5% of an average wall thickness of the second pipe.

22. The process of claim 13, wherein the heating step comprises adjusting respective temperatures of the first and second pipes during the hot extrusion to provide fluctuations in wall thickness of the second pipe after the hot extrusion of no greater than ±2.5% of an average wall thickness of the second pipe.

23. A process for manufacturing clad metal tubing from two different types of metals having different deformation resistances, which comprises:

preparing a billet comprising a first pipe having a first deformation resistance and a second pipe having a second deformation resistance, the second deformation resistance being greater than the first deformation resistance, the first and second pipes being arranged concentrically with each other, the first pipe comprising a carbon steel or low alloy steel and the second pipe comprising a nickel-base alloy, heating the billet;

adjusting heating temperatures of the first and second pipes such that the second pipe is at a higher temperature than the first pipe; and applying hot extrusion to the billet while maintaining the heating temperatures of the first and second pipes such that the second pipe is at a higher temperature than the first pipe.

24. A process for manufacturing clad metal tubing as set forth in claim 23, wherein the step of heating comprises heating the second pipe to a temperature 50° C. or more higher than the first pipe.

25. A process for manufacturing clad metal tubing as set forth in claim 24, wherein the step of heating comprises adjusting a temperature difference between the first and second pipes to provide a deformation resistance ratio of the first and second pipes in a deformation region during the hot extrusion of 2.5 or smaller.

26. A process for manufacturing clad metal tubing as set forth in claim 23, wherein the step of heating comprises heating the billet uniformly and then cooling the first pipe to a temperature 50° C. or more lower than the second pipe.

27. A process for manufacturing clad metal tubing as set forth in claim 26, wherein the step of heating comprises adjusting a temperature difference between the first and second pipes to provide a deformation resistance ratio of the first and second pipes in a deformation region during the hot extrusion of 2.5 or smaller.

28. A process for manufacturing clad metal tubing as set forth in claim 23, wherein the step of preparing the billet comprises preparing each of the first and second pipes from a wrought metal by machining.

29. A process for manufacturing clad metal tubing as set forth in claim 23, wherein the step of preparing the billet comprises preparing each of the first and second pipes from a powder-packed layer.

30. A process for manufacturing clad metal tubing as set forth in claim 29, further comprising subjecting the billet to cold isostatic pressing to increase compact density of each of the powder-packed layers prior to the hot extrusion step.

31. A process for manufacturing clad metal tubing as set forth in claim 23, wherein the step of preparing the billet comprises preparing the first pipe from a wrought metal by machining and preparing the second pipe from a powder-packed layer.

32. The process of claim 23, wherein a deformation resistance ratio of the first and second pipes is greater than 2.5 when the first and second pipes are at equal temperatures providing said equal temperatures are below temperatures at which a liquid phase of the metals comprising the first and second pipes is formed.

33. The process of claim 23, wherein the heating step comprises adjusting respective temperatures of the first and second pipes during the hot extrusion to temperatures below solidus lines of the metals comprising the first and second pipes.

34. The process of claim 23, wherein the heating step comprises adjusting respective temperatures of the first and second pipes during the hot extrusion to provide fluctuations in wall thickness of the second pipe after the hot extrusion of no greater than ±5% of an average wall thickness of the second pipe.

35. The process of claim 23, wherein the heating step comprises adjusting respective temperatures of the first and second pipes during the hot extrusion to provide fluctuations in wall thickness of the second pipe after the hot extrusion of no greater than ±2.5% of an average wall thickness of the second pipe.

* * * * *